United States Patent [19]

Kondo

[11] Patent Number: 4,922,297

[45] Date of Patent: May 1, 1990

[54] MOUNTING STRUCTURE OF PHOTOSENSITIVE DRUM

[75] Inventor: Akihiro Kondo, Sakai, Japan

[73] Assignee: Mita Industrial Co., Ltd., Osaka, Japan

[21] Appl. No.: 276,576

[22] Filed: Nov. 28, 1988

[30] Foreign Application Priority Data

Nov. 30, 1987 [JP] Japan ..... 62-301863

[51] Int. Cl.[5] ..... G03G 5/00; G03G 15/048; G03G 15/056

[52] U.S. Cl. ..... 355/211; 355/200

[58] Field of Search ..... 355/211, 212, 213, 200, 355/296, 245

[56] References Cited

U.S. PATENT DOCUMENTS

| | | | |
|---|---|---|---|
| 4,231,652 | 11/1980 | Moser et al. | 355/213 |
| 4,386,839 | 6/1983 | Kumagai et al. | 355/200 |
| 4,425,036 | 1/1984 | Kameyama et al. | 355/200 |
| 4,530,588 | 7/1985 | Kimura et al. | 355/211 |
| 4,598,992 | 7/1986 | Landa et al. | 355/211 |

FOREIGN PATENT DOCUMENTS

| | | | |
|---|---|---|---|
| 0161773 | 10/1982 | Japan | 355/211 |
| 0059476 | 4/1983 | Japan | 355/211 |
| 0182682 | 10/1983 | Japan . | |

*Primary Examiner*—A. T. Grimley
*Assistant Examiner*—Robert Beatty
*Attorney, Agent, or Firm*—Beveridge, DeGrandi & Weilacher

[57] ABSTRACT

A support shaft supporting a photosensitive drum detachable in the radial direction is supported by a bearing. This bearing is pressed and fixed by a specified device disposed at a specified position along the outer circumference of the photosensitive drum, and this device can be displaced from the specified position. A joint integrally rotatably linked to the support shaft and the photosensitive drum drive shaft is disposed so as to be able to be disconnected from either of the support shaft or the photosensitive drum drive shaft. This joint is engaged with a joint operating means for operating the joint. This joint operating means interlocks the placing action of the above device with the connecting action of the joint, and interlocks the displacing action of the device with the disconnecting action of the joint. Simultaneously with attaching/detaching of the device, the support shaft of the photosensitive drum and the photosensitive drum drive shaft are connected or disconnected.

4 Claims, 5 Drawing Sheets

MOUNTING STRUCTURE OF PHOTOSENSITIVE DRUM

BACKGROUND OF THE INVENTION

This invention relates to a mounting structure of a photosensitive drum capable of easily attaching a photosensitive drum on an electrostatic image forming apparatus and detaching the photosensitive drum from the same.

Conventionally, there have been provided image forming apparatus such as an electrostatic copying apparatus and a printer, in which mounting and dismounting of a photosensitive drum are performed by moving it in the radial direction.

In such an image forming apparatus, such a structure is generally employed that a photosensitive drum is supported in a condition to be driven, by connecting the end of a support shaft inserted into the photosensitive drum to a drive unit disposed in the main body of the apparatus (see Japanese Laid-open Patent Application No. 182682/1983 for example).

In the case of the above supporting structure, however, it is necessary to insert the support shaft into the photosensitive drum and draw out the support shaft from the photosensitive drum every time the photosensitive drum is mounted and dismounted. It is also necessary to engage the end of the support shaft inserted into the photosensitive drum with the drum drive unit. Therefore, the photosensitive drum cannot be detached or attached promptly.

Furthermore, when engaging the support shaft with the drum drive unit, positioning of the support shaft to fit to the drum drive unit was difficult, and it took time to engage the two. Still more, a considerable extra space was needed in the draw-out direction in order to draw out the support shaft from the drum drive unit, and a wide space was required for installation of the apparatus. This requirement for extra space was a particularly difficult problem when installing an image forming apparatus in which the overall length of the support shaft was long, for example, a large-sized image forming apparatus with the copy size of up to A0 (Japanese Industrial Standard) format.

SUMMARY OF THE INVENTION

It is hence a primary object of this invention to present a mounting structure of a photosensitive drum capable of detaching and attaching a photosensitive drum easily. It is another object of this invention to present a mounting structure of a photosensitive drum capable of reducing the space required for installation.

The above objects are achieved by a mounting structure of a photosensitive drum in which:

a support shaft supporting a photosensitive drum detachable in the radial direction is supported by a bearing, a joint intervening between the support shaft and a photosensitive drum drive shaft, and integrally rotatably linked to the support shaft and the photosensitive drum drive shaft is disposed so as to be disconnectable from either of the support shaft or the photosensitive drum drive shaft, the bearing is disposed at a specified position along the outer circumference of the photosensitive drum and is pressed and fixed by a specified device detachable from the above specified position, and joint operating means for operating the joint is engaged with the joint so that the joint is disconnected from either of the support shaft or the photosensitive drum drive shaft when the above device is displaced from the specified position, and that the joint is integrally rotatably linked to the support shaft and photosensitive drum drive shaft when the device is placed at the specified position.

With use of the foregoing structure, the specified device disposed at a specified position along the outer circumference of the photosensitive drum is displaced from this specified position, the stationary state of the bearing of the photosensitive drum is canceled, and the joint is disconnected from either of the support shaft or the photosensitive drum drive shaft by the joint operating means, so that the photosensitive drum may be detached.

When the specified device is placed after mounting the detached photosensitive drum on a specified position, the bearing of the photosensitive drum is arrested by this device, and, at the same time, the joint is integrally rotatably linked to the support shaft and photosensitive drum drive shaft by the joint operating means, so that it is ready to drive the photosensitive drum.

EMBODIMENT

One of the embodiments of this invention is described below in details while referring to the accompanying drawings.

Figure 5:
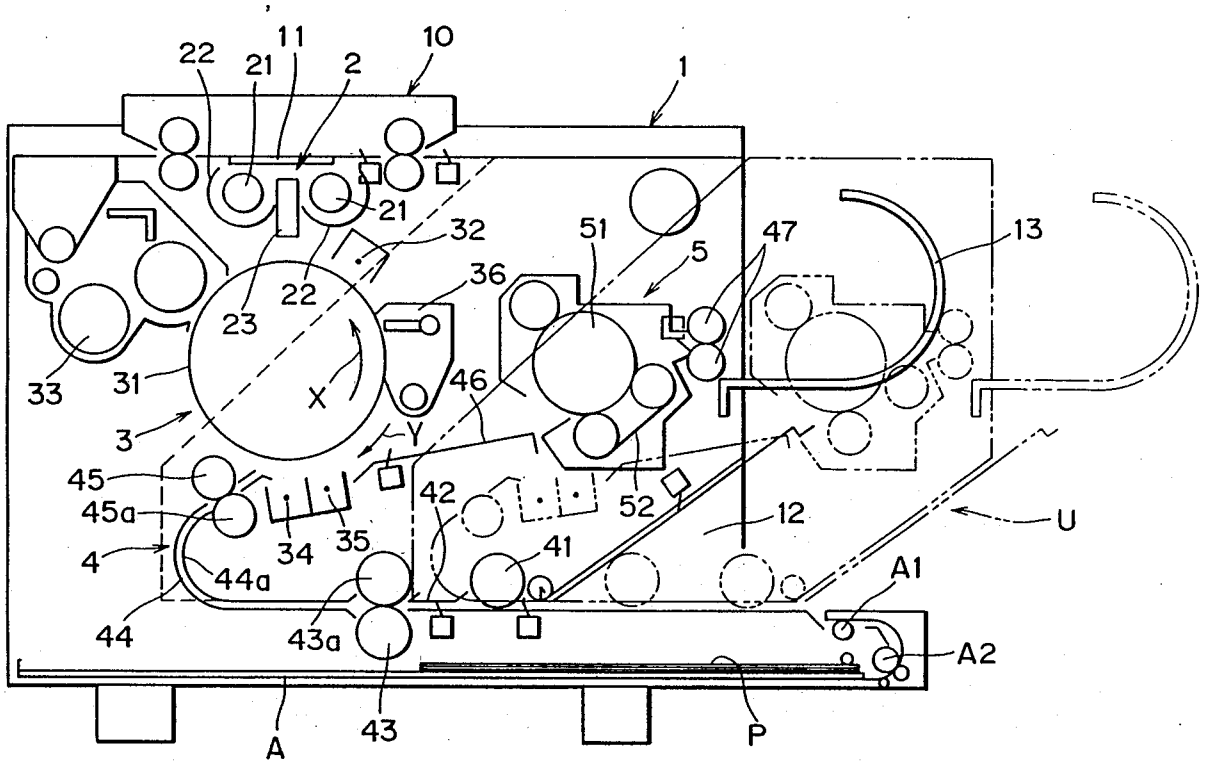
FIG. 5 is a schematic drawing showing the internal structure of a copying apparatus.

Referring first to FIG. 5, the copying apparatus employing this mounting structure of a photosensitive drum comprises an optical system 2 for scanning and exposure of an original document, disposed in the upper part inside the copying apparatus main body 1, a copying section 3 for forming a copy image on a paper P, disposed beneath the optical system 2, a paper conveying section 4 disposed extending from the underneath of the copying section 3 toward the front side of the copying apparatus (the right side of the drawing in FIG. 5), and fixing means 5 for fixing a toner image formed on the paper P, disposed at the front part of the paper conveying section 4.

The optical system 2 is composed of a light emitter 21, a reflector 22, a lens 23 and others, and it can scan and expose an original document conveyed on a transparent platen 11 by means of original conveying means 10.

The copying section 3 includes a photosensitive drum 31 rotating in the direction of arrow X in FIG. 5, and a charging corona discharger 32, a developing device 33, a transferring corona discharger 34, a separating corona discharger 35, and a cleaning device 36 which are sequentially disposed along the direction of arrow X around the photosensitive drum 31.

The copying process by the copying section 3 is as follows. First, the photosensitive drum 31 is uniformly charged by the charging corona discharger 32, and an image corresponding to the original document is focused on the photosensitive drum 31, and an electrostatic latent image based on this image is formed. This electrostatic latent image is made visible as a toner image by the developing device 33, and this toner image is transferred on the paper P by means of the transferring corona discharger 34. Afterwards, toner remaining on the photosensitive drum 31 is collected and removed by the cleaning device 36.

The paper conveying section 4 includes a paper feed roller 41, a first paper guide member 42, a pair of registration rollers 43, 43*a*, a pair of second paper guide members 44, 44*a* bent in U-form, a pair of delivery rollers 45, 45*a*, a third paper guide member 46, a pair of discharging rollers 47 and others in this sequence from the inner part of a paper inserting part 12 to the paper discharge side.

The paper conveying process by this paper conveying section 4 is as follows. First, the paper P supplied from a paper feeding cassette A or a paper inserting part 12 is conveyed by the paper feed roller 41 along the first paper guide member 42 and the second paper guide members 44, and then is led into the copying section 3 by the delivery rollers 45, 45*a*. Afterwards, the paper P on which the toner image is transferred by the copying section 3 is led into the fixing means 5 along the third paper guide member 46. The paper P on which the toner image has been heated and fused by this fixing means 5 is discharged onto a tray 13 by means of the discharge roller 47.

In addition, at the front end part of the paper feeding cassette A, there are provided paper feeding rollers A1, A2 for taking out and feeding the papers P stored in the cassette A, one by one.

The fixing means 5 includes a heating roller 51 and a pressure belt 52 opposite to the heating roller 51. The heating roller 51 is driven so as to rotate in the state of being heated to a specified temperature by heating means such as a heater provided on the inside thereof. The paper P with a toner image transferred thereon which has been led to the fixing means 5 is pressed against the heating roller 51 in a heated state by the pressure belt 52, and is conveyed to the discharge rollers 47 by the heating roller 51.

In this copying apparatus, the paper feeding roller 41 in the paper conveying section 4, the first paper guide member 42, the upper registration roller 43*a*, the inner second guide member 44*a*, the lower delivery roller 45*a*, the third paper guide member 46, the discharge roller 47, the transferring corona discharger 34, the separating corona discharger 35 and the fixing means 5 compose one unit U. This unit U is slidably disposed so as to be drawn out by a specified distance in the horizontal direction as indicated by double dot chain line in FIG. 5.

Figure 1:
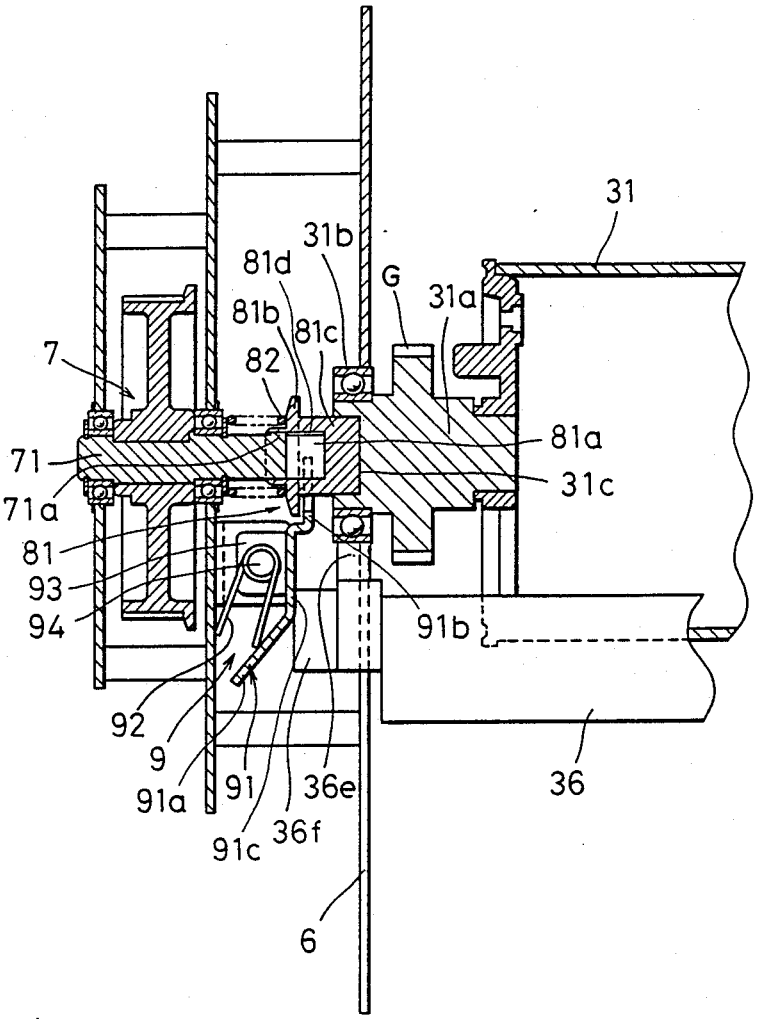
FIG. 1 is a cross sectional view showing a mounting structure of a photosensitive drum of this invention.
Figure 3:
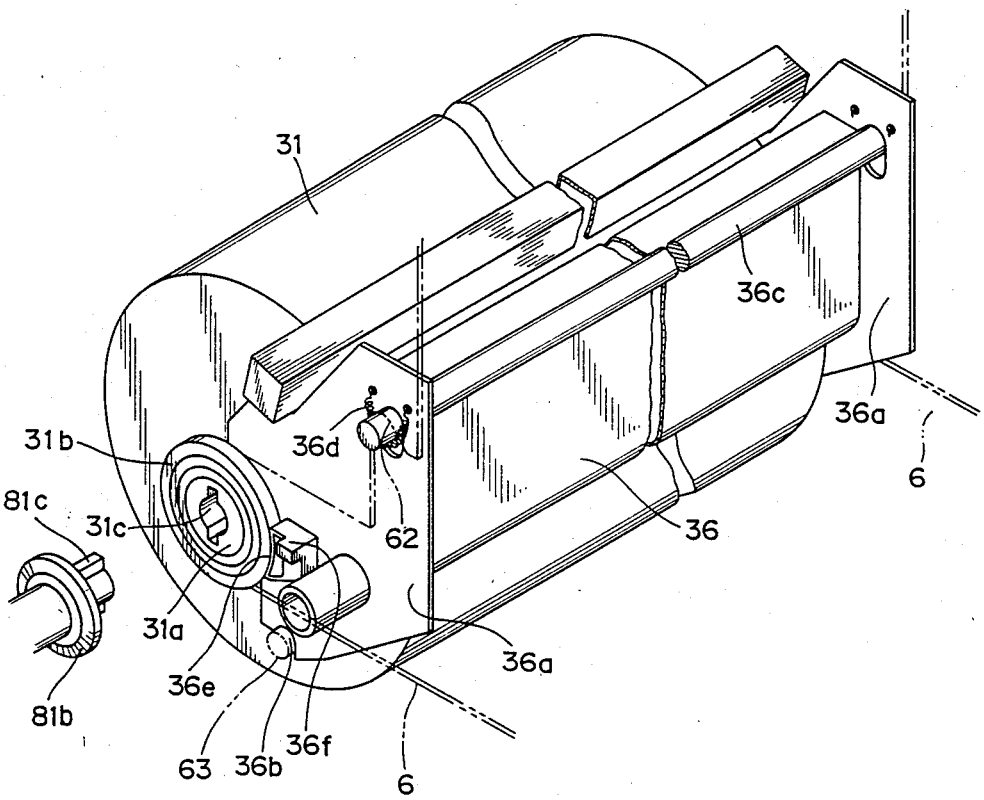
FIG. 3 is a perspective view of essential parts.

At both ends of the photosensitive drum 31, as shown in FIGS. 1 and 3, support shafts 31*a* are projected, and each support shaft 31*a* is inserted into a bearing 31*b*. The bearing 31*b* is supported by a side plate 6 in the state of being inserted into a bearing insertion groove 61 formed in the side plate 6.

Figure 4:
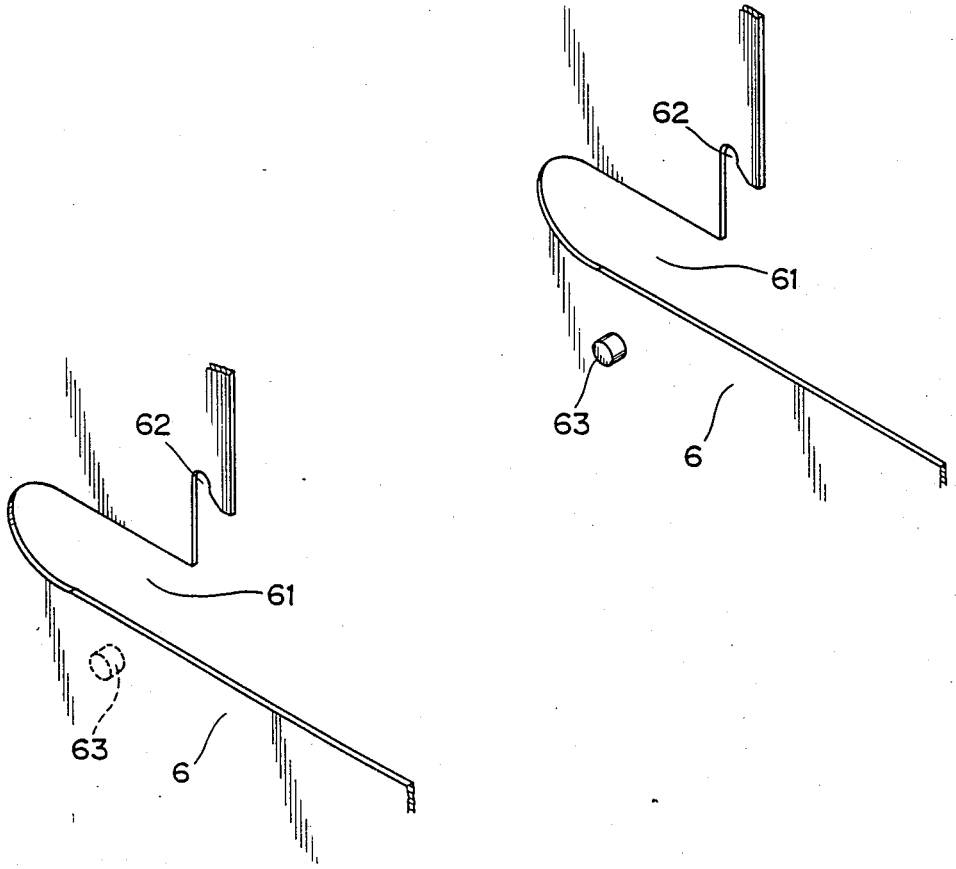
FIG. 4 is a perspective view of side plates.

The bearing insertion groove 61 is formed in a long groove shape extending in the unit U withdrawing direction in which the unit U is drawn out as shown in FIGS. 3 and 4. The end part of the bearing insertion groove 61 which faces toward the above drawing out direction is opened. This is for the movement of the bearing 31*b* in the horizontal direction. The upper part of the side plate 6 which continuously connects to the open side of the bearing insertion groove 61 is cut off so that the photosensitive drum 31 moving in the horizontal direction may be drawn out upward.

Figure 2:
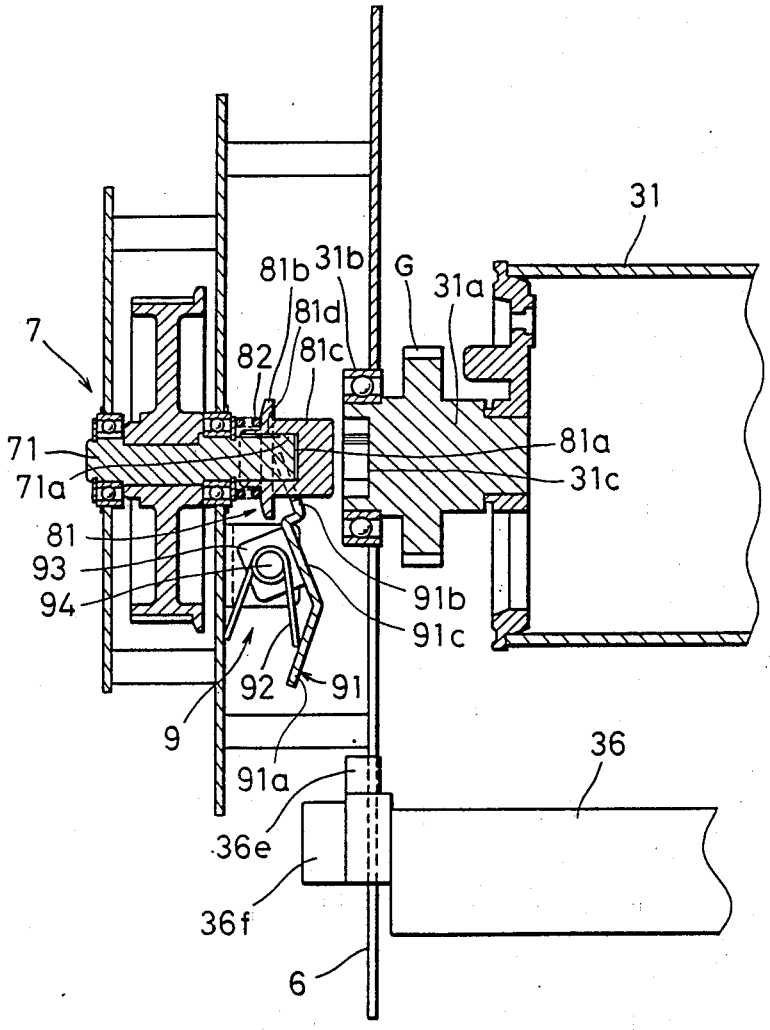
FIG. 2 is a cross sectional view showing the displaced state of a cleaning device.

The bearing 31*b* is supported on the side plate 6 in the state of being pressed to the inner side of the bearing insertion groove 61 by the cleaning device 36, which arrests the movement of the photosensitive drum 31 in the horizontal direction. Meanwhile, on the outer circumference of the support shaft 31*a*, a gear G for transmitting the driving force to the cleaning device 36 is formed as shown in FIGS. 1, 2.

At both ends of the cleaning device 36, there are side plates 36*a* as shown in FIG. 3, and at the lower end of the side plate 36*a*, an engaging groove 36*b* is formed. A projecting support pin 63 disposed at the inner side of the side plate 6 is engaged in this engaging groove 36*b*. There is also provided an engaging shaft 36*c* which passes through side plates 36*a*, engaging with engaging grooves 62 respectively formed in the side plates 6 at a specified position. In this way, the cleaning device 36 is mounted on the side plate 6.

The engaging shaft 36*c* is inserted in the side plate 36*a* of the cleaning device 36 so as to be freely movable vertically, and is elastically thrust upward by a coil spring 36*d* wound around at its lower side. By pushing down the engaging shaft 36*c* resisted by the coil spring 36*d*, the engagement of the engaging shaft 36*c* in the engaging grooves 62 is released. In this state, by rotating the cleaning device 36 in the Y-direction in FIG. 5, it is possible to take out the cleaning device 36 from the side plate 6.

On each side plate 36*a* of the cleaning device 36 there is, a pressing part 36*e* for pressing the bearing 31*b* on the support shaft 31*a* of the photosensitive drum 31 against the inner side of the bearing insertion groove 61, and also a cam part 36*f* for rotating a turning lever 91 in joint operating means 9 described later is formed.

On the other hand, as shown in FIG. 1, a drum drive shaft 71 which is driven by a driving system 7 of the copying apparatus is provided with a joint 81 which transmits the rotation of the drum drive shaft 71 to the support shaft 31*a* of the photosensitive drum 31 and can be disconnected from the support shaft 31*a*. This joint 81 has a shaft insertion hole 81*a*, a flange part 81*b*, and an engaging convex part 81*c*. The joint 81 has the drum drive shaft 71 inserted into the shaft insertion hole 81*a*, and is designed to slide in the axial direction of the drum drive shaft 71. In the shaft insertion hole 81*a*, a groove 81*d* to be engaged with the engaging convex part 71*a* of the drum drive shaft 71 is provided, and by this engagement the drum drive shaft 71 and the joint 81 can rotate as one body. The engaging convex part 81*c* is engaged with the concave part 31*c* of the support shaft 31*a* as shown in FIG. 3, which enables the joint 81 and the photosensitive drum 31 to rotate as one body. Besides, in the state of abutting against the flange part 81*b* of the joint 81, the joint 81 is elastically thrust toward the support shaft 31*a* by means of a coil spring 82.

This joint 81 is engaged with the joint operating means 9 for interlocking the placing action of the cleaning device 36 with the connecting action of the joint 81 to the support shaft 31*a*, and for interlocking the displacing action of the cleaning device 36 with the disconnecting action of the joint 81 from the support shaft 31*a*. This joint operating means 9 includes the turning lever 91 and a winding spring 92 as an elastic member. The turning lever 91 is installed so as to rotate about a shaft 94 by means of a support plate 93. The winding spring 92 is wound around the shaft 94, and presses one end 91*a* of the turning lever 91 to thrust and rotate the turning lever 91 counterclockwise. That is, the winding spring 92 is rotatably thrusting the turning lever 91 so as to move in a direction to disconnect the joint 81 from the support shaft 31*a*. The other end part 91*b* of the turning lever 91 is designed to be engaged with the flange part 81*b* of the joint 81 in the state that the turning lever 91 is rotated counterclockwise as shown in FIG. 2. The turning lever 91 is designed to rotate clockwise when its end part 91*a* is pushed by the cam part 36*f* of the cleaning device 36. Meanwhile, when the middle part 91*c* of the turning lever 91 is pressed by the cam part 36*f*, the engagement between the other end part 91*b* of the turning lever 91 and the flange part 81*b* is canceled.

In this aspect, as indicated by double dot chain line in FIG. 5, when the unit U is drawn out from the copying apparatus main body 1 and the cleaning device 36 is dismounted from the side plate 6, the engagement between the end part 91*a* of the turning lever 91 in the joint operating means 9 and the cam part 36*f* of the cleaning device 36 is released. Therefore, the turning lever 91 is rotated by the thrusting force of the winding spring 92, thereby disconnecting the joint 81 from the support shaft 31*a* of the photosensitive drum 31 (FIG. 2). At the same time, pressing and fixing of the bearing 31*b* by the cleaning device 36 is released, and therefore the photosensitive drum 31 may be easily dismounted from the copying apparatus main body 1 by moving the photosensitive drum 31 together with the bearing 31*b* in the direction in which the unit U is drawn out and successively pulling them upward.

When the dismounted photosensitive drum 31 is mounted again on the side plate 6 and the cleaning device 36 is put on the side plate 6, the bearing 31*b* of the photosensitive drum 31 is pressed and fixed by the cleaning device 36, and at the same time the end part 91*a* of the turning lever 91 in the joint operating means 9 is pressed by the pressing part 36*e* of the cleaning device 36, and the turning lever 91 is rotated, so that the engagement between the other end 91*b* of the turning lever 91 and the joint 81 is canceled. As a result, the joint 81 is moved toward the photosensitive drum 31 by the thrusting force of the coil spring 82 thereby to be engaged with the support shaft 31*a*.

In this embodiment, incidentally, instead of the cleaning device 36, it may be also possible to use, depending on the attaching and detaching direction of the photosensitive drum 31, the developing device 33 or the like that is provided dismountable along the outer circumference of the photosensitive drum 31. With use of the aforementioned device, the bearing 31*b* of the photosensitive drum 31 may be pressed and fixed, and also the turning lever 91 is operated.

It may be also possible to install the joint so as to be able to be disconnected from the photosensitive drum drive shaft 71.

This invention has been described in details herein on the basis of an embodiment of the mounting structure of a photosensitive drum while referring to the attached drawings, but the invention is not limited to the above embodiment alone, and it may be understood that other changes and modifications may be possible so far as not to depart from the true spirit of the invention.

Thus, according to the mounting structure of a photosensitive drum of the invention, when attaching or detaching a photosensitive drum, it is not necessary to pull out or insert the support shaft from or into the photosensitive drum, and therefore attaching or detaching may be done easily and promptly.

Furthermore, the joint is disconnected from either of the support shaft or the photosensitive drum drive shaft when the specified device is displaced from the specified position, and the joint is integrally rotatably linked to the support shaft and photosensitive drum drive shaft when the device is placed at the specified position, so that the detaching and attaching operation of the photosensitive drum may be done more easily and promptly.

Still more, an extra space for pulling out the support shaft of the photosensitive drum is not needed, and the space for installation may be saved.

What I claim is:

1. A mounting structure for a photosensitive drum in an image forming apparatus having a main body, comprising a support shaft for supporting the photosensitive drum, said support shaft being supported by a bearing and being detachable from the main body by movement in a radial direction;

a drive shaft for driving the photosensitive drum;

a joint means between the support shaft and the drive shaft, said joint means having an engaged position where it is rotatably linked to both of said shafts and being movable from said engaged position to a disengaged position where it is rotationally disconnected from one of said shafts, a specified device disposed along the outer circumference of the photosensitive drum, said specified device being normally in an attached position on said main body of the apparatus and being detachable from the main body, and a joint operating means for operating the joint means, said joint operating means being engaged with said joint means and being operable in response to movement of the specified device to and from its attached position, said joint operating means being operable to move the joint means to its engaged position when the specified device is moved to its attached position.

2. A mounting structure according to claim 1 wherein the joint operating means includes a lever which is movable between a joint-engaging position and a joint-disengaging position, said lever having a first end engaged with the joint means and a second end which is moved in response to said movement of the specified device to its attached position, and an elastic member biasing the lever to its joint-disengaging position.

3. A mounting structure according to claim 2 including a second elastic member biasing the joint means to its engaged position.

4. A mounting structure according to claim 1 wherein the main body has a slidable unit on which the photosensitive drum and the specified device are mounted.

* * * * *